US005295349A

United States Patent [19]

Okamoto

[11] Patent Number: 5,295,349

[45] Date of Patent: Mar. 22, 1994

[54] INTRODUCTION DEVICE FOR A SPINNING APPARATUS

[75] Inventor: Akira Okamoto, Jyoyo, Japan

[73] Assignee: Murata Kikai Kabushiki Kaisha, Kyoto, Japan

[21] Appl. No.: 920,789

[22] Filed: Jul. 28, 1992

[30] Foreign Application Priority Data

Jul. 30, 1991 [JP] Japan ..... 3-212748

[51] Int. Cl.[5] ..... D01H 5/28; D01H 1/115

[52] U.S. Cl. ..... 57/333; 57/328; 57/350; 57/352

[58] Field of Search ..... 57/332, 328, 341, 342, 57/343, 344, 350, 333, 352

[56] References Cited

U.S. PATENT DOCUMENTS 4,674,274 6/1987 Kato ..... 57/352 X
4,827,710 5/1989 Nishimura ..... 57/328
4,958,487 9/1990 Suganuma et al. ..... 57/343 X
5,088,265 2/1992 Suganuma et al. ..... 57/343 X
5,146,740 9/1992 Mori ..... 57/328
5,159,806 11/1992 Mori et al. ..... 57/328
5,193,335 3/1993 Mori ..... 57/328

*Primary Examiner*—Daniel P. Stodola
*Assistant Examiner*—William Stryjewski
*Attorney, Agent, or Firm*—Spensley Horn Jubas & Lubitz

[57] ABSTRACT

A pneumatic spinning apparatus comprises a nozzle block having a nozzle which gives a whirling air stream to a fiber bundle coming out of the draft device, a spindle having a fiber bundle passage, a guide member with its forward end protruding into a spindle inlet port, and an introduction tube having a fiber bundle passage which has been separated into a plurality of parts and fixed at the nozzle block inlet side.

10 Claims, 4 Drawing Sheets

INTRODUCTION DEVICE FOR A SPINNING APPARATUS

BACKGROUND OF THE INVENTION

1. Field of the Invention

The present invention relates to an apparatus for manufacturing a spun yarn by twisting an untwisted fiber bundle drafted by a drafting device, by applying a whirling stream of air to the fiber bundle, and more particularly, to a spinning apparatus for a bundle of long fibers.

2. Prior Art

An apparatus for producing a real twisted yarn wherein a guide member is provided within a nozzle block for exerting a turning air stream on a fiber bundle moved out of a drafting device with an extreme end thereof directed at an inlet of a rotating or stationary spindle is known by Japanese Patent Provisional Publication No. 161525/1991.

In the apparatus for producing a real twisted yarn constructed as described above, the fiber bundle moved out of the drafting device is attracted into the nozzle block and exposed to a turning stream in the vicinity of the inlet of the spindle and slightly twisted. At this time, all the fibers of the fiber bundle are positioned in the periphery of the guide member and directly exposed to an air flow to receive a force separating from the fiber bundle. However, since the extreme end of the fiber positioned at the inlet of the spindle is subjected to twisting, it is not easily separated. The separated rear end of the fiber is wound about the outer periphery of the spindle and extends outwardly. The fiber is gradually drawn while turning about the fiber bundle as the fiber bundle runs, and most fibers are spirally wound to form a real twist-like spun yarn.

The spinning apparatus described above is an excellent apparatus capable of manufacturing ring-twisted yarns of high quality both in appearance and strength characteristics because of an extremely large quantity of wound fiber. For spinning a long fiber such as wool, a spun yarn bundle, as shown in FIG. 8, which has much core fiber and little wound fiber is produced, due particularly in the case of wool to a long and thick fiber and a small number of component fibers in yarn.

In a general cotton yarn, the mean length of the short fibers is in the range of 23–25 mm and the number of short fibers constituting a cotton yarn having an Ne. of 30 is relatively large (on the order of about 100). On the other hand, in a wool yarn, the mean length of the long fibers is in the range of 60–80 mm, and the number of fibers constituting a wool yarn having an Ne. of 30 is relatively smaller (on the order of about 40).

Accordingly, if the long fiber bundle is spun using a known spinning device for a short fiber bundle, a bundled spun yarn as shown in FIG. 8, in which there are less wound fibers, is produced since separation of fibers can not be accomplished adequately and the number of fibers which are constituting wound fibers of a spun yarn is less.

OBJECT AND SUMMARY OF THE INVENTION

It is an object of the present invention to provide a pneumatic spinning apparatus suitable for producing yarns of long fibers.

To attain the above-described object, the spinning apparatus of the present invention comprises a nozzle block having a nozzle for giving a whirling air stream to a fiber bundle which has come out of a draft device; a spindle having a fiber bundle passage; a guide member with its forward end projecting into a spindle inlet port; and an introduction device having a plurality of separated fiber bundle passages and fixedly installed at the inlet side of the nozzle block. In this equipment, a distance from a nip point of front rollers to the spindle inlet port is set to a value of 0.75 to 1.25 times larger than a mean fiber length of a fiber bundle supplied.

In the spinning apparatus of the aforesaid constitution, the fiber bundle that has come out of the draft device is forced to pass by an air stream being jetted out of the nozzle, through in a space of each fiber bundle passage of the introduction tube the interior of which is separated into a plurality of passages, being drawn into the apparatus. The leading end of all fibers of the fiber bundle which is being pulled by the fiber bundle is formed into a yarn, being led from around the guide member into the spindle. The rear end of the fiber turns back at the spindle inlet port, being separated to each fiber. The separated fibers of the rear end of the yarn are exposed to the whirling air stream jetted out of the nozzle, and are wound, with the travel of the yarn, in a spiral form around the fiber bundle being formed into a yarn, thus becoming a fully twisted spun yarn.

DETAILED DESCRIPTION OF PREFERRED EMBODIMENT

An embodiment of a spinning apparatus according to the present invention will be explained with reference to the attached drawings.

Figure 1:
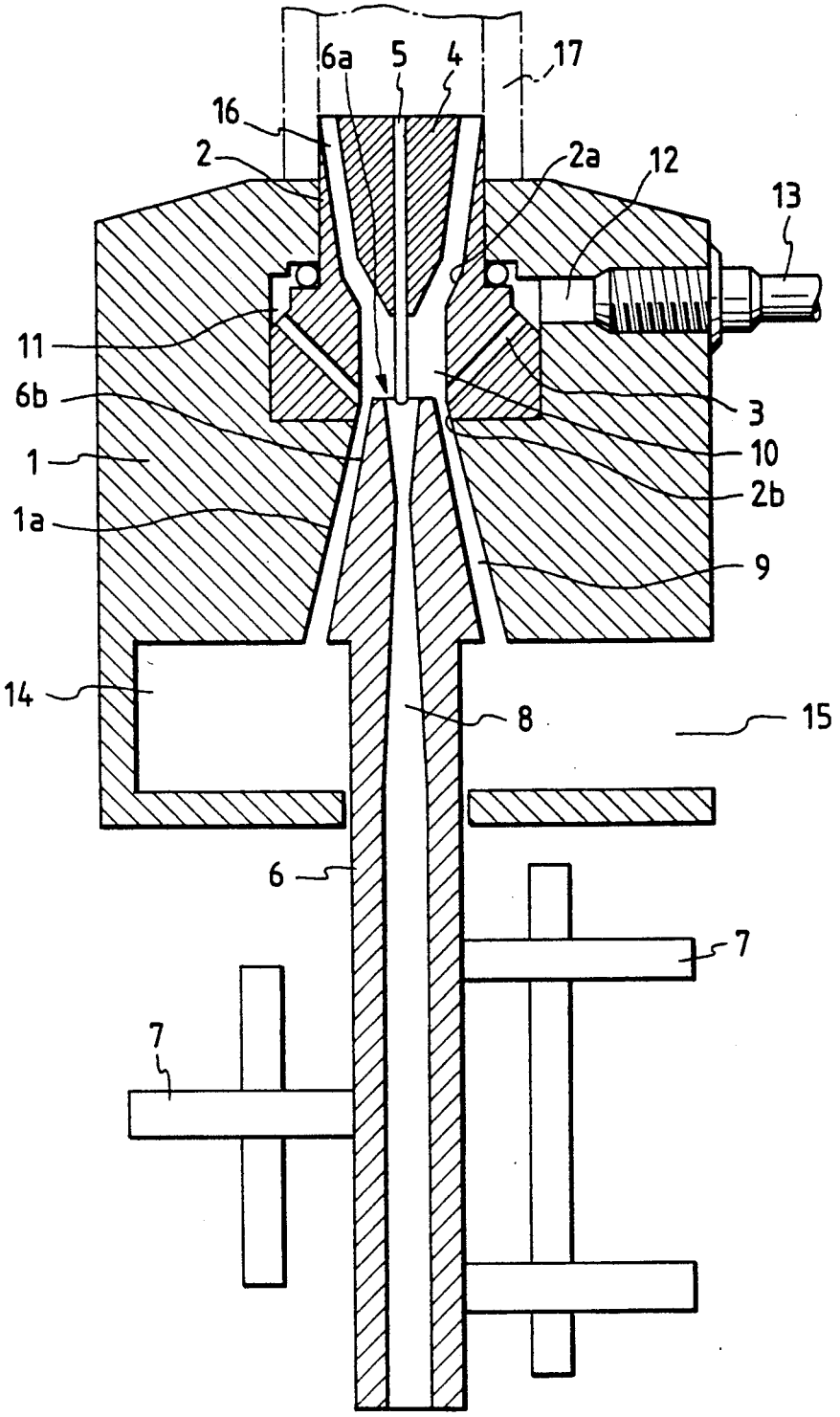
FIG. 1 is a longitudinal sectional view of the essential part of a spinning apparatus.

A spinning apparatus is, as shown in FIG. 1, comprises a nozzle block 2 having a nozzle 3 which gives a whirling air stream to a fiber bundle coming out of a drafting device, a spindle 6 (not needed to be turned) which has a fiber bundle passage 8 and is driven by a driving device such as a driving roller; a guide member support 4 fixed inside of the nozzle block 2; and a guide member 5 with its forward end protruding out into the spindle inlet port 6a and mounted to the guide member support 4.

Figure 2A:
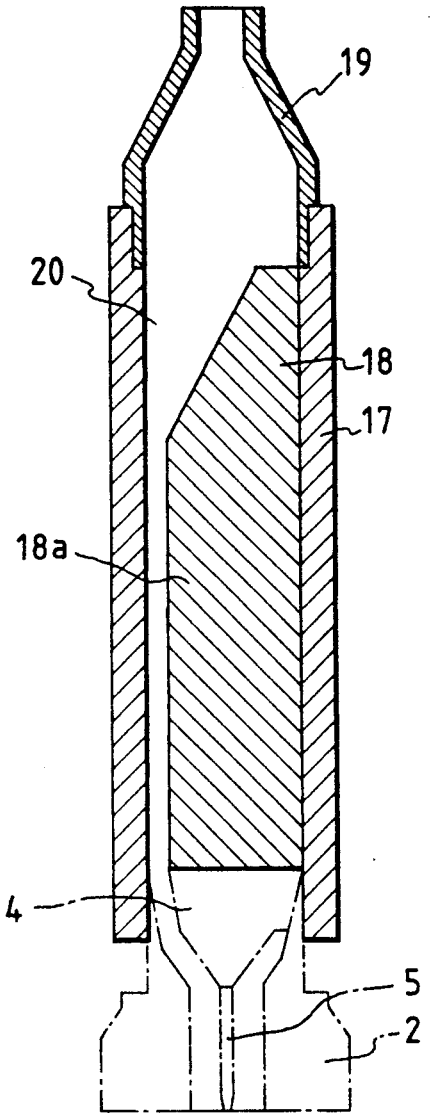
FIG. 2*a* is a longitudinal sectional view of an introduction device.
Figure 9:
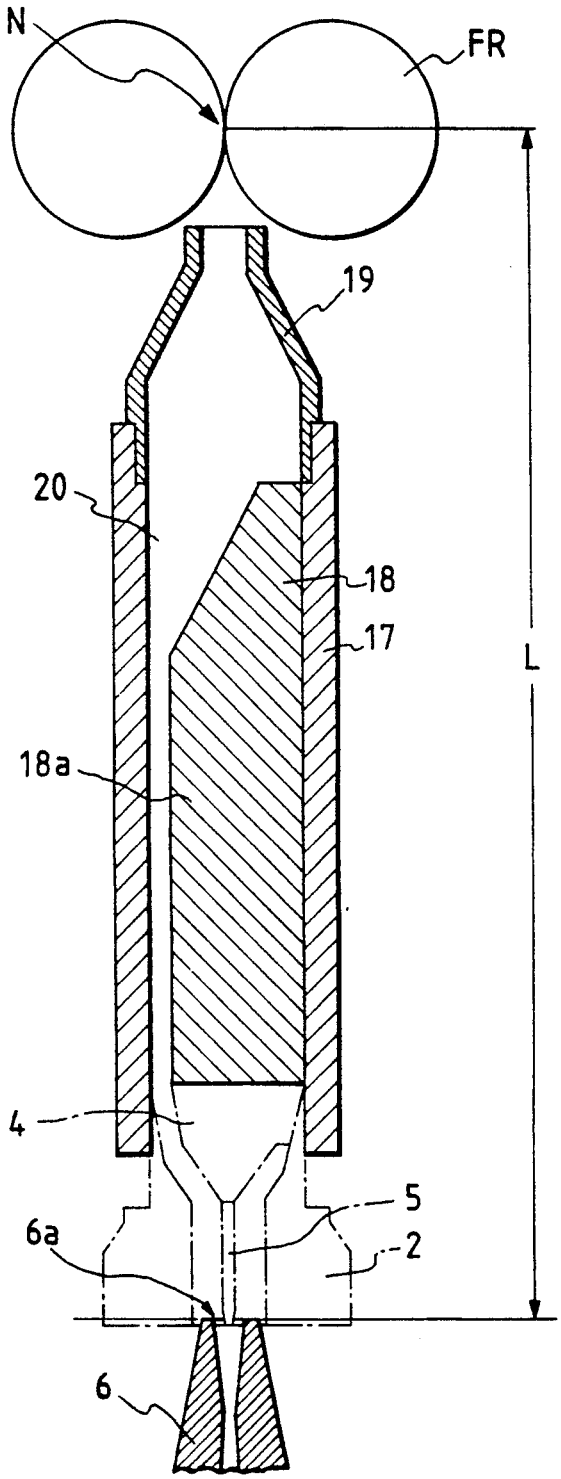
FIG. 9 is a longitudinal sectional view showing an arrangement of the introduction device in the spinning apparatus.

This spinning apparatus consists of a spinning body shown in FIG. 1 and an introduction device (see FIGS. 2a, 2b and 3) fixed at the inlet of a nozzle block 2 thereof, and is located next to a draft part which includes a back roller, a middle roller with an apron, and a front roller FR, as shown in FIG. 9.

First the main body of the spinning apparatus will be explained by referring to FIG. 1.

The body is composed of the nozzle block 2 having a nozzle 3 disposed in a casing 1, a guide member support 4 fixed therein and having a guide member 5, and a rotating spindle 6 with its inlet side inserted in the casing 1.

The spindle 6 is supported by three rollers 7 (one of them is located at the foreground of FIG. 1 which is not illustrated) mounted around and in contact with the outside surface of the spindle 6. One of the rollers 7 is a driving roller, which can be rotated at as high a speed as 50,000 to 200,000 rpm as compared with a type (30,000 rpm) driven by turning the spindle 6 through a driving belt.

The spindle 6 is provided with the fiber bundle passage 8 formed through at the center thereof. The center of this passage 8 and the center of the casing 1 are on the same straight line which registers with the passage through which the fiber bundle travels. The inlet port 6a of the spindle 6 has a substantially small outer diameter; a portion following the inlet port 6a makes a conical section 6b which increases as the outer diameter goes toward the downstream side.

A part of the casing 1 covering the conical section 6b of the spindle forms a tapered section 1a which opens in a form of trumpet along the outside diameter of the conical section 6b of the spindle 6, forming an annular space 9 between the casing 1 and the conical section 6b.

On the inlet side of the casing 1 is fitted the nozzle block 2, through which a fiber bundle passage 10 is formed. This fiber bundle passage 10 is contracted at an intermediate section by a tapered section 2a and at the downstream side by a tapered section 2b which continues to a tapered section 1a of the casing 1.

In the casing 1 a hollow air chamber 11b is provided between the casing 1 and the nozzle block 2. The nozzle block 2 has four air injection nozzles 3 communicating with the air chamber 11, and directed downstream a little off the spindle inlet port 6a, in a tangential direction in relation to the fiber bundle passage 10. To the air chamber 11 is connected an air hose 13 through a bore 12. The nozzle 3 is set in the same direction as the direction of rotation of the spindle 6.

On the downstream side of the annular space 9 in the casing 1 are formed an annular hollow chamber 14 and an air escape hole 15 continuing in the tangential direction to the hollow chamber 14. Connected to this air escape hole 15 is an air suction pipe.

Compressed air supplied through the hose 13 flows into the air chamber 11 and then is jetted out from the nozzle 3 into the annular space 9 of the casing 1, producing a high-speed whirling air stream in the vicinity of the spindle inlet port 6a. This air stream, after whirling in the annular space 9, is led from the hollow chamber 14 into the escape hole 15, being discharged out. At the same time, this air stream generates a suction air stream which flows from the nip point N of the front roller FR into the hollow section of the casing 1 through an introduction tube 17.

A clearance 16 is provided between the nozzle block 2 and the guide member support 4, serving as a fiber bundle guide passage. The guide member support 4 has, in the longitudinal direction, a small-diameter hole formed by drilling in line with the centerline of the passage 8 of the spindle 6. In this small-diameter hole is inserted the pin-like guide member 5.

The guide member 5 protrudes out of the small-diameter hole of the guide member support 4 with its free forward end being exposed into the spindle inlet port 6a. The guide member 5 is smaller in diameter than the passage in the spindle inlet port 6a, and its forward end is formed with a smooth curve.

The forward end of the guide member 5, in the drawing, is slightly exposed into the passage 8 from the spindle inlet port 6a. This is the most desirable state, in which a yarn produced presents the closest resemblance to that of the ring yarn. However, it is possible to position the guide member 5 apart from the end face of the inlet port 6a depending upon a condition, to thereby produce a yarn having an appearance close to the ring yarn. The yarn thus produced can stand comparison with the ring yarn in a respect of strength characteristic.

Next, the introduction device will be explained.

The introduction device consists of a cylindrical introduction tube 17 having a fiber bundle passage 20 which is of the same diameter as the outer diameter of the inlet section of the nozzle block 2; a fiber bundle separating member 18 having a separating wall 18a; and a cap 19 having a flat inlet 19a and fitted in the inlet of the introduction tube 17.

Figure 2B:
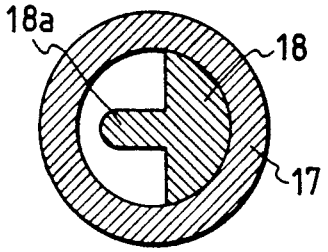
FIG. 2*b* is a cross sectional view of the introduction device shown in FIG. 2*a*.
Figure 3:
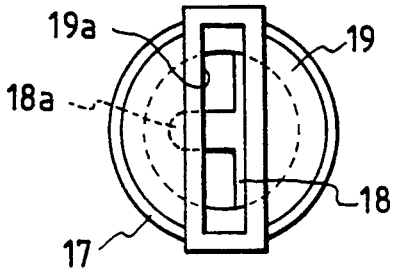
FIG. 3 shows the introduction device viewed from the inlet side.
Figure 4:
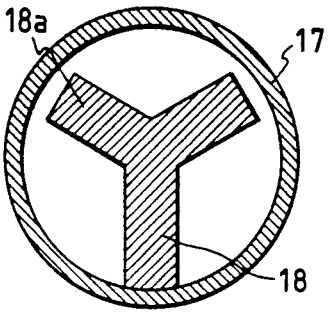
FIG. 4 is a cross sectional view of the introduction device provided with a fiber separating body which separates a fiber bundle passage into three parts.
Figure 5:
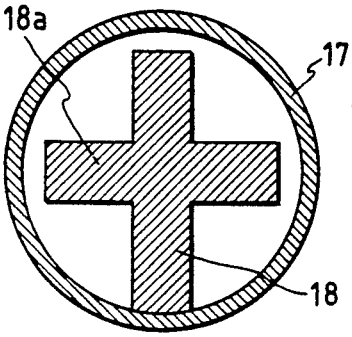
FIG. 5 is a cross sectional view of the introduction device provided with a fiber separating body which separates a fiber bundle passage into four parts.
Figure 6:
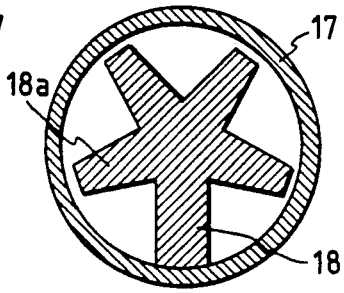
FIG. 6 is a cross sectional view of the introduction device provided with a fiber separating body which separates a fiber bundle passage into five parts.

The separating wall 18a of the fiber separating member 18 has a cross sectional form depicted in the introduction tube 17 of FIG. 2b. This example shows a fiber bundle passage 20 of the introduction tube 17 divided into two parts. The fiber separating member 18 may have two or more separating walls 18a as shown in FIGS. 4 to 6. Furthermore, the guide member support 4 may have the appearance that the separating wall 18a of the separating member 18 is extended. In this spinning apparatus, the same number of drafted fiber bundles as the number of spaces separated by the separating walls 18a are separately introduced from the cap inlet 19a.

The distance L from nip point N of the front roller FR of the draft part to the spindle inlet port 6a is set, in a conventional cotton yarn spinning, somewhat shorter than the mean fiber length of the fiber bundle supplied. In the present invention, according to tests, a desirable result of spinning can be obtained by setting the distance L to 0.75 to 1.25 times longer than the mean fiber length.

Figure 7:
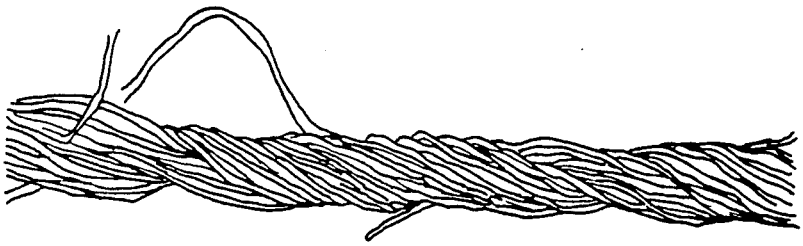
FIG. 7 is an enlarged view of a fully twisted spun yarn manufactured by the spinning apparatus of the present invention.
Figure 8:
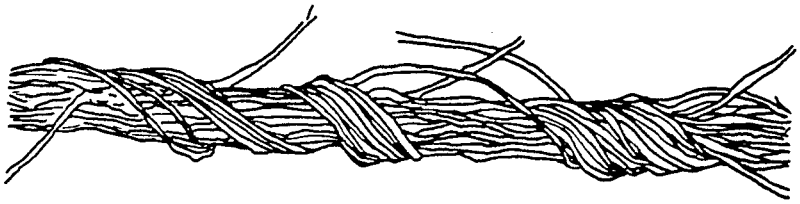
FIG. 8 is an enlarged view of a bundled spun yarn.

In the spinning apparatus of such a constitution, several fiber bundles that have left the front roller FR of the draft device are drawn, by the action of an air stream being jetted out of the nozzle 3, into the casing 1 from a clearance 16 between the nozzle block and the guide member support 4 through the spaces in the fiber bundle passage 20 of the introduction tube separated by the separating wall 18a. The leading end of every fiber of the fiber bundle being drawn by the fiber bundle being formed into a yarn, is led into the spindle from around the guide member 5. Also the rear end of the fiber turns back at the spindle inlet port 6a, being separated into fibers. The rear-end fiber thus separated is exposed to the whirling air stream being jetted out from the nozzle 3, being wound in a spiral form around the fiber bundle being formed into a yarn, that is, an actually fully-twisted spun yarn as shown in FIG. 7, as the yarn runs. The guide member 5 functions as a so-called false core which prevents twist propagation in the yarn forming process or temporarily serves as a substitute of a core fiber bundle, and prevents the formation of an untwisted core fiber bundle which occurs remarkably in conventional pneumatically bundled spun yarn, thus forming a yarn of practically wound fibers alone.

A yarn producing process using the apparatus of the present invention will be further described hereinafter.

The sliver supplied from the front roller FR is passing over the yarn introduction tube 17 in the state that the sliver is divided in substantially two by the separating wall 18*a*. So, the probability of occurrence of separation of the fibers at the rear end portion thereof is increased compared with the case of using apparatus having no separating wall. It is due the fact that the outer surfaces of the divided two sliver like yarns are larger than the surface of the sliver like a yarn which is not divided. According to the present invention, the separation of fibers are promoted if the sliver is constituted less long fibers, and as a result the wound fibers are increased.

Furthermore, since each divided fiber bundles is advanced being twisted around the guide member 5 under the influence of the swirling air stream jetted from the nozzle 3, fibers constituting a core of a yarn are slightly twisted and the separated fibers are wound around the twisted core fibers to produce the actually twisted spun yarn as shown in FIG. 7. In the embodiment mentioned above, the separating wall 18*a* is so provided as to have a clearance between the inner wall of introduction tube 17 the separating wall 18*a*. However, it is possible that and the separating wall 18*a* may be formed to contact with the inner face of the introduction tube 17 so that the inner space of the introduction tube 17 is completely divided in two separated portions.

The reason why the distance L between the nip point N of the front roller FR and the inlet port 6*a* of the spindle 6 is set in the range as described above is as follows. In case of long fibers of such as a wool yarn, the length of constituting fibers are distributed in the range of about 30–160 mm and the mean value of the length of the constituting fibers is about 80 mm. Accordingly, if the distance L is set to be 0.75 to 1.25 times longer than the mean fiber length, almost fibers are arranged within the introduction tube 17 to be nipped at the one end of the fibers by the front rollers FR and it may become possible to transfer the each single fiber regulating it. So, the unevenness of the drafting operation can be avoided and a yarn having good appearance can be obtained.

In the example of the spinning equipment explained above, the spindle 6 was rotated; in this case the spindle 6 is used as an auxiliary means for twisting the yarn. Some yarns, however, do not necessarily require the rotation of the spindle 6 for twisting.

The present invention, being constituted as heretofore explained, has the following advantage.

It is, therefore, possible to manufacture spun yarns wound with an extremely large amount of fiber and having desirable appearance and strength characteristics well comparable with ring spun yarns as is in the case of spun cotton yarns.

What is claimed is:

1. In a spinning system having a draft device for feeding a fiber bundle, a spinning apparatus comprising:

a nozzle block having a nozzle for directing a whirling air stream toward the fiber bundle fed from the draft device, a spindle defining an inlet and a first fiber bundle passage, a guide member having a forward end protruding into the inlet of the spindle, and an introduction device for guiding and separating the fiber bundle fed from the draft device, the introduction device being positioned at a inlet side of the nozzle block and defining a longitudinal axis and a second fiber bundle passage divided into a plurality of sub-passages that are substantially parallel to the longitudinal axis.

2. The spinning apparatus of claim 1, wherein the fiber bundle defines a mean fiber length, wherein the draft device comprises a pair of front rollers defining a nip point in spaced relationship with the inlet of the spindle, and wherein the distance between the nip point and the inlet of the spindle is between approximately 0.75 and 1.25 times greater than the mean fiber length of the fiber bundle.

3. The spinning apparatus of claim 1, wherein the nozzle block has an inlet section defining an outer diameter, wherein the fiber bundle passage defines a diameter that is substantially equal to the outer diameter of the inlet section of the nozzle block, wherein the introduction device comprises a substantially cylindrical introduction tube, and further comprising a fiber bundle separating member located in the second fiber bundle passage and having at least one separating wall for defining at least one of the plurality of sub-passages.

4. The spinning apparatus of claim 3, wherein the introduction tube defines an inlet and wherein the introduction device further comprises a cap positioned in the inlet of the introduction tube and having a flat inlet.

5. The spinning apparatus of claim 3, further comprising a guide member support for supporting the guide member and wherein the separating wall of the fiber bundle separating member is extended and is secured to the separating member.

6. The spinning apparatus of claim 1, wherein the spindle defines an outer surface and further comprising:

a plurality of rollers mounted around and in contact with the outer surface of the spindle for supporting the spindle, wherein at least one of the rollers comprises a driving roller for rotating the spindle at high speed.

7. In a spinning system having a draft device for feeding a fiber bundle, a spinning apparatus comprising:

a nozzle block having a nozzle for directing a whirling air stream toward the fiber bundle fed from the draft device and having an inlet section defining an outer diameter, a spindle defining an inlet and a first fiber bundle passage, a guide member having a forward end protruding into the inlet of the spindle, an introduction device comprising a substantially cylindrical introduction tube positioned at the inlet section of the nozzle block and defining a longitudinal axis, the introduction device defining a second fiber bundle passage divided into a plurality of sub-passages that are substantially parallel to the longitudinal axis, the fiber bundle passage defining a diameter that is substantially equal to the outer diameter of the inlet section of the nozzle block, and a fiber bundle separating member located in the second fiber bundle passage and having at least one separating wall for defining at least one of the plurality of sub-passages, wherein the separating wall of the fiber bundle separating member comprises a plate-like member extending along the longitudinal axis of the introduction device and dividing the second fiber bundle passage into two sub-passages.

8. In a spinning system having a draft device for feeding a fiber bundle, a spinning apparatus comprising:

a nozzle block having a nozzle for directing a whirling air stream toward the fiber bundle fed from the draft device and having an inlet section defining an outer diameter, a spindle defining an inlet and a first fiber bundle passage, a guide member having a forward end protruding into the inlet of the spindle.

an introduction device comprising a substantially cylindrical introduction tube positioned at the inlet section of the nozzle block and defining a longitudinal axis, the introduction device defining a second fiber bundle passage divided into a plurality of sub-passages that are substantially parallel to the longitudinal axis, the fiber bundle passage defining a diameter that is substantially equal to the outer diameter of the inlet section of the nozzle block, and a fiber bundle separating member located in the second fiber bundle passage and having at least one separating wall for defining at least one of the plurality of sub-passages, wherein the separating wall extends along the longitudinal axis of the introduction device and divides the second fiber bundle passage into three sub-passages.

9. In a spinning system having a draft device for feeding a fiber bundle, a spinning apparatus comprising:

a nozzle block having a nozzle for directing a whirling air stream toward the fiber bundle fed from the draft device and having an inlet section defining an outer diameter, a spindle defining an inlet and a first fiber bundle passage, a guide member having a forward end protruding into the inlet of the spindle, an introduction device comprising a substantially cylindrical introduction tube positioned at the inlet section of the nozzle block and defining a longitudinal axis, the introduction device defining a second fiber bundle passage divided into a plurality of sub-passages that are substantially parallel to the longitudinal axis, the fiber bundle passage defining a diameter that is substantially equal to the outer diameter of the inlet section of the nozzle block, and a fiber bundle separating member located in the second fiber bundle passage and having at least one separating wall for defining at least one of the plurality of sub-passages, wherein the separating wall extends along the longitudinal axis of the introduction device and divides the second fiber bundle passage into four sub-passages.

10. In a spinning system having a draft device for feeding a fiber bundle, a spinning apparatus comprising:

a nozzle block having a nozzle for directing a whirling air stream toward the fiber bundle fed from the draft device and having an inlet section defining an outer diameter, a spindle defining an inlet and a first fiber bundle passage, a guide member having a forward end protruding into the inlet of the spindle, an introduction device comprising a substantially cylindrical introduction tube positioned at the inlet section of the nozzle block and defining a longitudinal axis, the introduction device defining a second fiber bundle passage divided into a plurality of sub-passages that are substantially parallel to the longitudinal axis, the fiber bundle passage defining a diameter that is substantially equal to the outer diameter of the inlet section of the nozzle block, and a fiber bundle separating member located in the second fiber bundle passage and having at least one separating wall for defining at least one of the plurality of sub-passages, wherein the separating wall extends along the longitudinal axis of the introduction device and divides the second fiber bundle passage into five sub-passages.

* * * * *